US007122504B2

(12) United States Patent
Watanabe et al.

(10) Patent No.: US 7,122,504 B2
(45) Date of Patent: Oct. 17, 2006

(54) PROTECTIVE LAYER TRANSFER SHEET AND AN IMAGE FORMING METHOD EMPLOYING IT

(75) Inventors: Hiroshi Watanabe, Fussa (JP); Hiroaki Yamagishi, Hachioji (JP); Hirokazu Koyama, Hino (JP); Hiroki Nakane, Hachioji (JP)

(73) Assignee: Konica Minolta Photo Imaging, Inc., Tokyo (JP)

( * ) Notice: Subject to any disclaimer, the term of this patent is extended or adjusted under 35 U.S.C. 154(b) by 197 days.

(21) Appl. No.: 10/945,047

(22) Filed: Sep. 20, 2004

(65) Prior Publication Data

US 2005/0068407 A1 Mar. 31, 2005

(30) Foreign Application Priority Data

Sep. 29, 2003 (JP) ..... 2003-337289

(51) Int. Cl.
*B41M 5/035* (2006.01)
*B41M 5/38* (2006.01)

(52) U.S. Cl. ..... 503/227; 428/195.1; 503/201

(58) Field of Classification Search ..... None
See application file for complete search history.

(56) References Cited

U.S. PATENT DOCUMENTS 5,322,832 A 6/1994 Takeyama et al.

FOREIGN PATENT DOCUMENTS

| | | |
|---|---|---|
| GB | 2353101 A | 2/2001 |
| JP | 04-142987 | 5/1992 |
| JP | 05-0427741 | 2/1993 |
| JP | 05042774 | 2/1993 |
| JP | 237363 | 9/1995 |
| JP | 07-276831 | 10/1995 |
| JP | 2000-168244 | 6/2000 |

*Primary Examiner*—Bruce H. Hess
(74) *Attorney, Agent, or Firm*—Lucas & Mercanti, LLP

(57) ABSTRACT

Disclosed is a protective layer transfer sheet for forming an image by the method which comprising the steps of overlaying a thermal transfer image receiving sheet and a thermal transfer recording ink sheet, forming an image on the thermal diffusible dye receiving layer by heating, and forming a protective layer on the image by transferring the thermal transferable protective layer unit by heating, in which the thermal transferable protective layer unit is constituted by plural transferable resin layers and at least one of the resin layers contains a metal ion-containing compound and a layer other than the resin layer containing the metal ion-containing compound contains a UV absorbent, and a barrier layer is arranged between the metal ion-containing layer and the UV absorbent containing layer.

20 Claims, 2 Drawing Sheets

PROTECTIVE LAYER TRANSFER SHEET AND AN IMAGE FORMING METHOD EMPLOYING IT

FIELD OF THE INVENTION

This invention relates to a protective layer transfer sheet to be employed-in a dye thermal transfer recording and an image forming method employing the protective layer transfer sheet, more in detail, relates to a protective layer transfer sheet and an image forming method employing that by which an image superior in the storage ability of the printed image and the durability of the image can be obtained.

TECHNICAL BACKGROUND

Hitherto, a method has been known as the color or monochromatic image forming techniques, in which an ink sheet containing a thermal diffusible dye capable of diffusing and transferring by heating is faced to an image receiving layer of a image receiving sheet and the image diffusible dye is imagewise transferred to-the image receiving layer using a heat printing means such as a thermal head or a laser to form an image, so called as a dye thermal transfer method. Such the thermal transfer method is known as a method by which the image formation employing digital data is made possible and a high quality image being a much for that of silver salt photographic image can be obtained without the use of any developer.

However, the image obtained by such the method has a drawback such as that the image is inferior in the storage ability and the durability of the image to that of the silver salt photographic image.

A thermal transfer material and an image forming method using it, hereinafter referred to as a post-chelating method, employing a thermal diffusible dye capable of forming a chelate, hereinafter referred to as a post-chelate dye, have been proposed to improve the stability of the image, particularly, the fixing ability and the light fastness of it, as is shown in, for example, Japanese Patent Document Open to Public Inspection, hereinafter referred as Japanese Patent O.P.I. Publication, Nos. 59-78893, 59-109349 and 60-2398.

Moreover,. Japanese Patent O.P.I. Publication No. 4-89292 proposes a method in which the dye is further subjected to heat after the transfer for improve the storage ability of the image obtained by the post-chelating method.

As the method for improving the mechanical durability (resistivity against wearing and skin oil contamination) of the image formed by the thermal dye transfer method, a method has been known in which a transparent protective layer is formed on the image by thermal transfer process, and a method for forming a transparent protective layer by the thermal transfer process on the image formed by the post-chelating method are disclosed.

Moreover, a method for improving the storage ability of the image obtained by the post-chelating method by addition of a metal ion-containing compound into the transparent protective layer for accelerating the chelating reaction of the unreacted dye remaining just after the printing is disclosed, for example, in Patent Documents 1 and 2.

As one of the methods for forming the transparent protective layer on the image formed by the thermal dye transfer method, a constitution in which an UV absorbent is contained in the transparent protective layer is disclosed, for example, in Patent Documents 3 through 5. The method of employing the UV absorbent regarding to the thermal dye transfer method employing the post-chelating technique is also described-in the foregoing Patent Documents 1 and 2. However, when the transparent protective layer contains both of the metal ion compound and the known UV absorbent in the thermal dye transfer method utilizing the post-chelating method, a problem is raised-that the whiteness of the background of the whole image is degraded by coloring caused by the reaction of the metal ion compound and the UV absorbent by heating on the occasion of the transferring of the transparent protective layer after the image formation. Furthermore, it is a drawback that the transparent protective layer before the transference itself is colored during the storage for long period.

Patent Document 1; Japanese Patent O.P.I. Publication No. 5-42774

Patent-Document 2; Japanese Patent O.P.I. Publication No. 2000-168244

Patent Document 3; Japanese Patent Examined Publication No. 2925699

Patent Document 4; Japanese Patent Examined Publication No. 3395090

Patent Document 5; Japanese Patent O.P.I. Publication No. 7-276831

DISCLOSURE OF THE INVENTION THE INVENTION AND PREFERABLE EMBODIMENT

The present invention is attained to responding to the, foregoing situation. The object of the invention is to provide the protective layer transfer sheet and the image forming method to be used in the post-chelating method to form an image excellent in the high image density, sensitivity, physical properties of the surface and storage ability.

The above object of the invention can be attained by the following.

1. A protective layer transfer sheet comprising a transferable image protective layer unit on an support for forming a protective layer by thermally transferring on an image which is formed by overlaying a thermal transfer image receiving sheet having a diffusible dye receiving layer on an support and a thermal transfer recording ink sheet having an ink layer containing a thermal diffusible dye capable of forming a chelate complex with a compound containing a metal ion and heating according to signals to be recorded, wherein the transferable image protective layer unit comprises plural transferable resin layers and at least one of the resin layers contains the metal ion-containing compound and the resin layer other than the resin layer containing the metal ion-containing compound contains a UV absorbent and a barrier layer is between the resin layer containing the metal ion-containing compound and the resin layer containing the UV absorbent.

2. The protective layer transfer sheet of 1, wherein the UV absorbent is an inorganic oxide having a UV absorbing ability.

3. The protective layer transfer sheet of 2, wherein the inorganic oxide having the UV absorbing ability is fine powder of titanium oxide or zinc oxide each having an average diameter of not more than 200 nm.

4. The protective layer transfer sheet of anyone of 1 through 3, wherein at least one of the inorganic oxide having the UV absorbing ability is a UV absorbing resin.

5. The protective layer transfer sheet of anyone of 1 through 4, wherein the ink layer of the thermal transfer recording ink sheet and the transferable image protective layer unit are provided on the same support in this frame order.

6. The protective layer transfer sheet of anyone of 1 through 4, wherein the transferable image protective layer unit is provided on the support other than the support on which the ink layer of the thermal transfer recording ink layer.

7. An image forming method comprising the steps of overlaying a thermal transfer image receiving sheet having a diffusible dye receiving layer on an support and a thermal transfer recording ink sheet having an ink layer containing a thermal diffusible dye capable of forming a chelate complex with a compound containing a metal iony heating according to signals to be recorded to form an image in the diffusible dye receiving layer, and forming the protective:layer by thermal transfer employing the protective layer transfer sheet descried in anyone of 1 through 6.

The protective layer transfer sheet and the image forming method to be used in the post-chelating method to form an image excellent in the high image density, sensitivity, physical properties of the surface and storage ability can be provided by the invention.

THE PREFERRED EMBODIMENT OF THE INVENTION

The best embodiment of the invention is described in detail below.

It has been found by the inventors as a result of their investigation that an image excellent in the high density, sensitivity, the surface properties and the storage ability can be obtained by the use of a protective layer transfer sheet. The sheet has a transferable image protective layer unit on an support for forming a protective layer by thermally transferring on an image which is formed by overlaying a thermal transfer image receiving sheet having a thermal diffusible dye receiving layer on an support and a thermal transfer recording ink sheet having an ink layer containing a thermal diffusible dye capable of forming a chelate complex with a compound containing a metal ion and heating the thermal transfer image receiving sheet and the thermal transfer recording ink sheet according to signals to be recorded, in which the transferable image protective layer unit comprises plural transferable resin layers and at least one of the resin layers contains the metal ion-containing compound and the resin layer other than the resin layer containing the metal ion-containing compound contains a UV absorbent and a barrier layer is between the resin layer containing the metal ion-containing compound and the resin layer containing the UV absorbent.

The invention is described in detail below.

Firstly, the protective layer transfer sheet according to the innovation is described.

The protective layer transfer sheet has a transferable image protective layer unit on an support, in which the transferable image protective layer unit comprises plural. transferable resin layers and at least one of the resin layers contains the metal ion-containing compound and the resin layer other than the resin layer containing the metal ion-containing compound contains a UV absorbent and a barrier layer is provided between the resin layer containing the metal ion-containing compound and the resin layer containing the UV absorbent.

Figure 1:
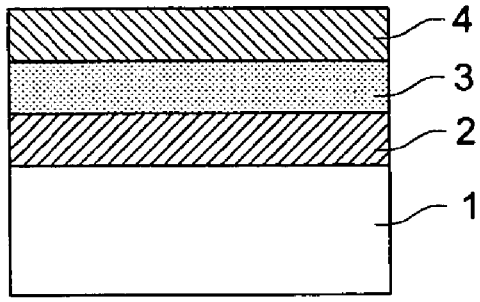
FIG. 1 shows a schematic illustration of the transferable protective layer unit to be provided on the protective layer transfer sheet according to the invention.
Figure 1:
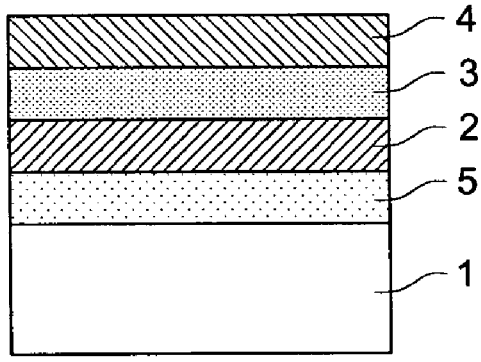
Figure 1:
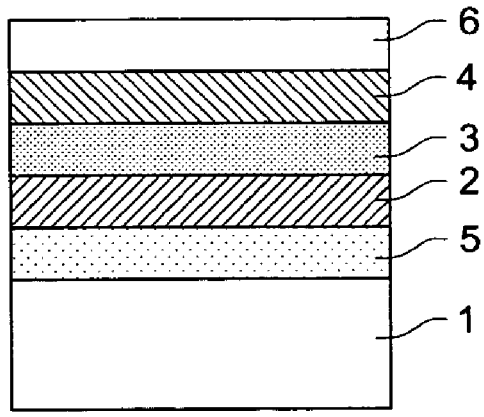

An example of the protective layer transfer sheet is displayed in FIG. 1.

FIG. 1*a* shows the most basic constitution, in which a first resin layer 2 and a second resin layer 4 are provided on a support 1, and a barrier layer 3 is arranged between the first resin layer 2 and the second resin layer 4. One of the first resin layer 2 and the second resin layer 4 contains the metal ion-containing compound and the other resin layer contains the UV absorbent.

In the arrangement shown in FIG. 1*b*, a parting layer 5 for easily parting the protective layer unit on the occasion of the thermal transfer is provided between the support 1 and the first resin layer 2. It is preferable that the parting layer is adhered with the support and has no transfer ability.

FIG. 1*c* shows a constitution in which an adhering layer 6 is further provided on the outermost surface of the protective layer shown in FIG. 1(*b*).

As the support to be employed in the protective layer transfer sheet, supports employed in usual thermal transfer sheet can be employed without any rearrangement. Concrete examples of the preferable support include thin paper such as glassine paper, condenser paper and paraffin paper, elongated or non-elongated film of plastic, for example, polyester having high thermal resistivity such as polyethylene terephthalate, polyethylene naphthalate, polyphenylene sulfide, polyether ketone and polyether sulfone, and polypropylene, polycarbonate, cellulose acetate, a polyethylene derivative polyvinyl chloride, polyvinylidene chloride, polystyrene, polyamide, polyimide, polymethylpentene and an ionomer, and a laminated film of these materials.

Though the thickness of the support can be optionally selected according to the material so that the strength, thermal conductivity and heat resistivity are made suitable, one having a thickness of from 1 to 100 μm is usually preferable and one having a thickness of from 1 to 20 μm is more preferably employable.

(Transferable Resin Layer)

Examples of the resin constituting the resin layer include polyester resins, polystyrene resins, acryl resins, polyurethane resins, acryl urethane resins, polycarbonate resins, epoxy modified resins of the above-mentioned, a mixture of the above, and an ionizing radiation hardenable resin. The UV absorbing resin later-mentioned may be employed as the resin constituting the transferable resin layer. As the preferable resins, the polyester resins, acryl resins, the polycarbonate resins, the epoxy-modified resins and the ionizing radiation hardenable resins are cited. As the polyester resin, aliphatic cyclic polyester resins containing one or more kinds of diol component and acid component are preferable. As the polycarbonate resin, aromatic polycarbonate resins are preferable and the aromatic polycarbonate resins described in Japanese Patent O.P.I. Publication No. 11-151867 are particularly preferred.

Examples of the epoxy-modified resin include epoxy-modified urethane, epoxy-modified polyethylene phthalate, epoxy-modified polyphenylene sulfide, epoxy-modified cellulose, epoxy-modified polypropylene, epoxy-modified polyvinyl chloride, epoxy-modified polycarbonate, epoxy-modified acryl, epoxy-modified polystyrene, epoxy-modified polymethyl methacrylate, epoxy-modified silicone, a copolymer of epoxy-modified polystyrene and epoxy-modified polymethyl methacrylate and a copolymer of epoxy-modified acryl and epoxy-modified silicone. Among them, the epoxy-modified acryl, epoxy-modified polystyrene, epoxy-modified polymethyl methacrylate and epoxy-modified silicone are preferable, and the copolymer of epoxy-modified polystyrene and epoxy-modified polymethyl methacrylate, the copolymer of epoxy-modified acryl and epoxy-modified polystyrene, and the copolymer of epoxy-modified acryl and epoxy-modified silicone are more preferable.

The ionized radiation hardenable resin is employed, for example, one prepared by crosslinking and hardening a radical polymerizable polymer or oligomer by irradiation of ionizing radiation and polymerized and hardened by electron rays or UV rays after addition of a photopolymerization initiator according to necessity is usable.

The thickness of each of the transferable resin layers is preferably from 1 to 10 μm.

(Metal Ion-containing Compound)

It is one of the features that at least one of the resin layer in the transferable resin layers contains a metal ion-containing compound, hereinafter also referred to as the metal source.

As the metal source, inorganic or organic acid salts or complexes of a metal ion are usable and the organic acid salts and complexes are preferred. As the metal, mono- and poly-valent metals included in I through VIII Groups of the periodical table are employable. Among them, Al, Co, Cr, Cu, Fe, Mg, Mn, Mo, Ni, Sn, Ti and Zn are preferable, and Ni, Cu, Cr, Co and Zn are particularly preferable. Concrete examples of the metal source include salts of fatty acid such as acetic acid and stearic acid and salts of aromatic carboxylic acid such as benzoic acid and salicylic acid with $Ni^{2+}$, $Cu^{2+}$, $Cr^{2+}$, $Co^{2+}$ and $Zn^{2+}$.

Complexes represented by the following Formula I are particularly preferred as the metal source since the complexes can be stably added into the binder resin in the post-heating region and are substantially colorless.

$$[M(Q_1)_X(Q_2)_Y(Q_3)_Z]^{P+}(L^-)_P \qquad \text{Formula I}$$

In the above Formula I, M is a metal ion, preferably $Ni^{2+}$, $Cu^{2+}$, $Cr^{2+}$, $Co^{2+}$ and $Zn^{2+}$, $Q_1$, $Q_2$ and $Q_3$ are each a coordination compound capable of coordinating with the metal ion represented by M, and the coordination compounds represented by $Q_1$, $Q_2$ and $Q_3$ may be the same as or different from each other. The coordination compounds can be selected from the compounds described in "Kireto Kagaku (Chelate Science) 5", Nankodo. $L^{31}$ is an organic anionic group such as tetraphenyl anion boron and alkylbenzene sulfonic acid anion. X is 1, 2 or 3, Y is 1, 2 or 0 and Z is 1 or 0. As concrete examples of the metal source, the compounds described in U.S. Pat. No. 4,987,049, Compounds No. 1 through 99 described in Japanese Patent O.P.I. Publication No. 9-39432, and the compounds represented by the following Formula II described in Japanese Patent O.P.I. Publication No. 10-241410 are preferable.

$$M^{2+}(X_1^-)_2 \qquad \text{Formula II}$$

In Formula II, $M^{2+}$ is a di-valent transition metal, among the metal ions represented by $M^{2+}$, nickel and zinc are preferred from the viewpoint of color of the metal ion supplying compound itself and that of chelated dye. $X_1^-$ is a coordination compound capable of forming a complex with the di-valent metal ion. These compounds ma have a neutral ligand typically such as $H_2O$ and $NH_3$ according to the central metal.

The content of the metal ion-containing compound is preferably from 1 to 80%, and more preferably from 1 to 50%, by weight of the whole weight of the resin layer in view of the improvement of the light fastness and the mechanical strength of the resin layer containing the metal ion-containing compound.

A UV absorbent is contained in a resin layer without the metal ion-containing compound among the resin layers constituting the transferable image protective layer unit.

Compound having absorbance within the UV region can be employed as the UV absorbent. The UV absorbents described in Japanese Patent O.P.I. Publication Nos. 59-158287, 63-74686, 63-145089, 59-196292, 62-229594, 53-122596, 61-183595 and 1-204788, and compounds capable of improving the durability of the image in the image recording material such as that used for photography are employable.

As such the UV absorbent, salicylic acid type, benzophenone type, benzotriazole type and cyanoacrylate type UV absorbents are employable. In concrete, the UV absorbents are available on the market, for example, in the trade name of Tinuvin P, Tinuvin 234, Tinuvin 320, Tinuvin 326, Tinuvin 327, Tinuvin 328, Tinuvin 312 and Tinuvin 315, each manufactured by Ciba-Geigy Ltd., Sumisorb-110, Sumisorb-130, Sumisorb-140, Sumisorb-200, Sumisorb-250, Sumisorb-300, Sumisorb-320, Sumisorb-340, Sumisorb-350 and Sumisorb-400, each manufactured by Sumitomo Chemical Co., Ltd., and Mark LA-32, Mark LA-36 and Mark 1413, each manufactured by Adeca-Argus Kagaku Co., Ltd. The above-mentioned are employable.

It is preferable that the inorganic oxide having the UV absorption ability is employed as the UV absorbent. As the inorganic oxide having the absorption ability, ones having the UV absorption in the UV region not more than 400 nm are preferable. Examples of the inorganic oxide include metal oxides such as titanium oxide, zinc oxide, magnesium oxide, tin oxide, indium oxide and silicon oxide, ITO and ceramics, and oxide containing two or more kind of metals including a rare metal usually employed in a superconductive material, each having a controlled particle diameter.

Among the inorganic oxides having the UV absorption ability, ones controlled in the particle diameter to not more than 200 nm, a half of the wavelength of visible rays are preferred to keep the lightness of the transparent image or reflective image since high transparency can be obtained when the image receiving layer is constituted. Minute particles of transparent titanium oxide or zinc oxide controlled in the particle diameter to not more than 200 nm are preferable, and those controlled in the particle diameter to not more than 50 nm are particularly preferred.

UV absorbing resins are also suitably employable as the UV absorbent. A copolymer of a reactive UV absorbent and an acryl type monomer is usable as the UV absorption resin. As the reactive UV absorbent, non-reactive UV absorbent such as silicate type, benzophenone type, benzotriazole type, substituted acrylonitrile type, nickel chelate type and hindered amine type UV absorbent each introduced with an additional polymerizable double bond such as a vinyl group, an acryloyl group, methacryloyl group and methacryloyl group, an alcoholic hydroxyl group, an amino group, a carboxyl group, an epoxy group or isocyanate group are usable. In concrete, the reactive UV absorbents are available on the market under the trade name of UVA635L, UVA633L, each manufactured by BASF Japan Co., Ltd., and PUVA-30M, manufactured by Otsuka Chemical Co., Ltd.; they can be employable. In the UV absorbing resin of the copolymer of the reactive UV absorbent and the acryl type monomer, the amount of the reactive UV absorbent is from 10 to 90% by weight, preferably from 30 to 70% by weight. The molecular weight of the UV absorbing resin may be about from 5,000 to 250,000, preferably about 9,000 to 30,000. The Tg of the UV absorbing resin is preferably not less than 60° C. and more preferably not less than 80° C. These UV absorbent may be employed singly or in a combination of two or more kinds.

The adding amount of the UV absorbent in the resin layer is preferably from 0.5 to 60%, and more preferably from 1 to 50%, by weight of the whole weight of the resin layer containing the UV absorbent, and the UV absorbing resin is suitably employed in an amount of from 0.5 to 100% by weight of the whole resin layer containing the UV absorbing resin in case that the UV absorbent is the UV absorbing resin, to expect sufficient UV absorbing effect without adverse deterioration.

(Barrier Layer)

A barrier layer is provided between the resin layer containing the metal ion-containing compound and the resin layer containing the UV absorbent.

The barrier layer is a layer to prevent the color formation by the contacting and interaction of the UV absorbent contained in the UV absorbent-containing layer and the metal ion-containing compound contained in the metal ion-containing compound containing resin layer caused by the interlayer diffusion of them during the storage or heating on the occasion of the transfer-of the protective layer.

The barrier layer is a resin layer. The resins to be employed for the foregoing transferable resin layer can also be employed. It is not desirable that the barrier layer contains the metal ion-containing compound and the UV absorbent for the purpose of the layer to prevent the contact of the metal ion-containing compound.

The thickness of the barrier layer is preferably from 1.0 to 10 μm, and more preferably from 1.0 to 5.0 μm.

(Parting Layer)

The protective layer unit is preferably provided on the support in the presence of the parting layer between them.

The non-transferable parting layer is preferably contains (1) an inorganic fine particle having an average diameter of not more than 40 nm in an amount of from 30 to 80 parts by weight together with a parting resin binder, (2) a copolymer of an alkylvinyl ether and maleic anhydride, a derivative thereof or a mixture thereof in an amount of not less than 20% by weight in total, or (3) an ionomer in an amount of not less than 20% by weight to the purpose of that the adhesiveness between the support and the non-transferable parting layer is made constantly and sufficiently higher than that between the non-transferable parting layer and the thermal transferable protective layer, and the adhesiveness between the non-transferable parting layer and the thermal transferable protective layer before the heat applying is made higher than that after heating.

Another additive may be added to the non-transferable parting layer according to necessity.

As the inorganic fine particle, for example, silica fine particle such as anhydride silica and colloidal silica, and metal oxide such as tin oxide, zinc oxide and antimony oxide an be employed. The particle diameter of the inorganic fine particle is preferably not more than 40 nm. When the particle diameter exceeds 40 nm, the irregularity of the surface of the thermal transferable protective layer is increased as a result of the irregularity of the parting layer so as to lower the transparency of the protective layer.

As the resin to be mixed with the inorganic fine particles, almost resins capable of mixing can be employed without any limitation. Examples of the resin include polyvinyl alcohol resins having various saponification degrees (PVA); polyvinyl acetal resins; polyvinyl butyral resins; acryl resins; polyamide resins; cellulose based resins such as cellulose acetate, an alkyl cellulose, carboxymethyl cellulose and an hydroxyalkyl cellulose; and polyvinyl pyrrolidone resins. The mixing ratio of the inorganic fine particles to the other components, principally the binder resin, (inorganic fine particles/the other components) is preferably within the range of not less than 30/70 and not more than 20/80 by weight. When the mixing ratio is less than 30/70, the effect of the inorganic fine particles is insufficient, and when the ratio is more than 30/70, the parting layer cannot be formed as the complete layer and a pert is formed where the support and the protective layer is directly contacted. As the copolymer of alkylvinyl ether and maleic anhydride of derivative thereof, for example, one in which the alkyl group of the alkylvinyl ether moiety is a methyl group or an ethyl group and one in which the moiety of maleic anhydride is partially or completely formed half ester with an alcohol such as methanol, ethanol, propanol, iso-propanol, butanol and iso-butanol, are employable.

Though the parting layer may be formed only by the copolymer of vinyl alkyl ether and maleic anhydride, the derivative thereof or the mixture thereof, another resin or a fine particle may be further added for controlling the parting force between the parting layer and the protective layer. In such the case, it is desirable that the copolymer of vinyl alkyl ether and maleic anhydride, the derivative thereof or the mixture thereof is contained in a ratio of not less than 20% by weight. When the content is less than 20% by weight, the effect of the copolymer of vinyl alkyl ether and maleic anhydride or the derivative thereof cannot be sufficiently obtained.

As the resin or fine particles to be mixed with the copolymer of vinyl alkyl ether and maleic anhydride or the derivative thereof, ones capable of mixing and giving a high transparency on the occasion of the layer formation can be employed without any limitation. For example, the foregoing inorganic particle and the resin capable of mixing with the inorganic particle are preferably employed.

As the ionomer, Serlin A, manufactured by du Pont Co., Ltd., and Chemipearl S series, manufactured by Mitsui Sekiyu Kagaku Co., Ltd., are usable. To the ionomer, for example, the foregoing inorganic fine particle, the-resin binder capable of mixing with the inorganic fine particle, another resin or another fine particle may further added.

(Adhering Layer)

An adhering layer may be formed on the outermost surface of the thermal transferable protective layer. The adhering layer may be formed by a resin having high thermal adhering ability such as acryl resins, vinyl chloride resins, vinyl acetate resins, and vinyl chloride/vinyl acetate copolymer resins, polyester resins and polyamide resins. The ionizing radiation hardenable resin and the UV cutting resin may be further mixed with the above-mentioned resin according to necessity. The thickness of the adhering layer is usually from 0.1 to 5.0 μm.

To form the thermal transferable image-protective layer unit on the non-transferable parting layer of the support, for example, coating liquids for forming the layers such as the protective layer coating liquids each containing the metal ion-containing compound or the UV absorbent and the protective layer forming resin, a barrier layer coating liquid, an adhering layer coating liquid containing the thermal adhesive resin and a coating liquid of an additional layer added according to necessity are previously prepared and coated and dried on the non-transferable parting layer of the support in the designated order. The coating liquids may be coated by usual coating methods. A suitable primer layer may be provided between each of the layers according to necessity.

<Thermal Transfer Recording Link Sheet>

The thermal transfer recording ink sheet, hereinafter also referred to as the thermal transfer sheet has an ink layer containing a thermal diffusible dye.

Figure 2:
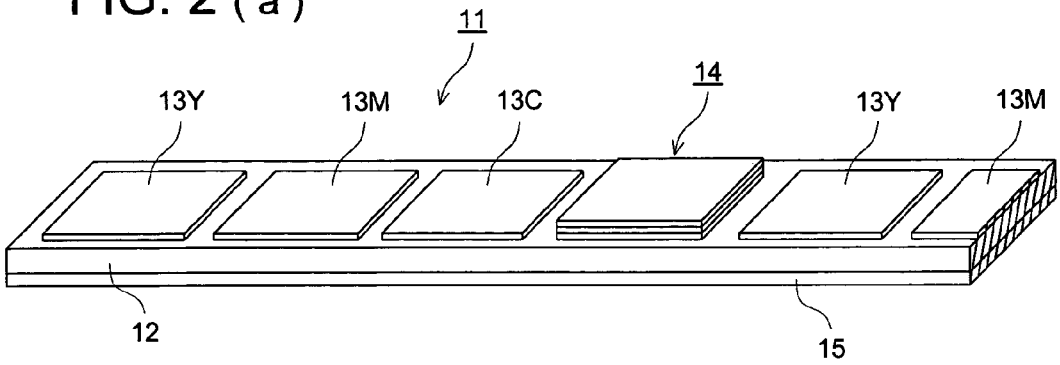
FIG. 2 shows an oblique view of an example of the thermal transfer recording ink sheet according to the invention.
Figure 2:
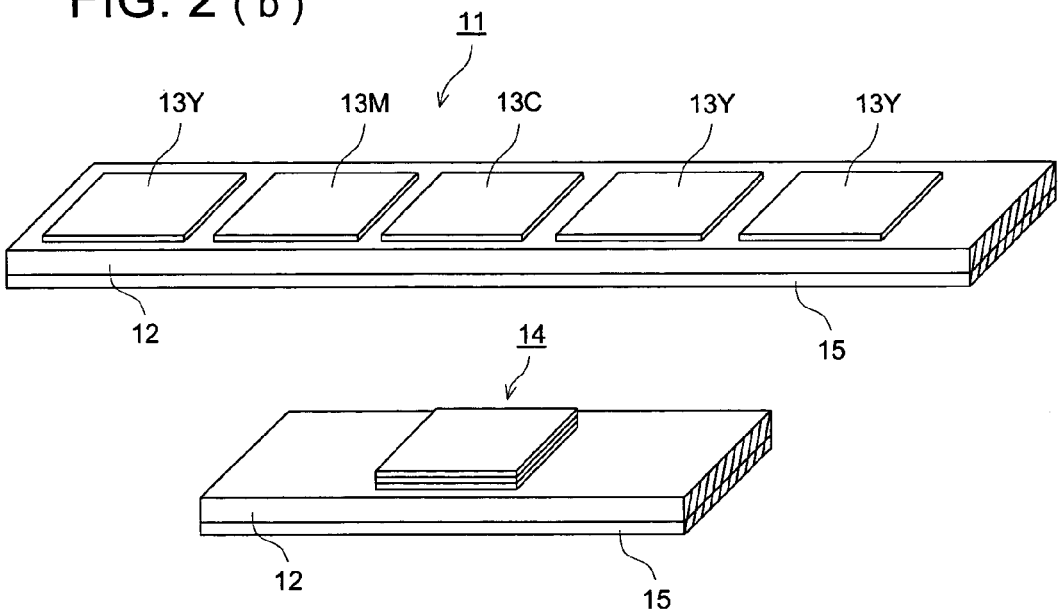

FIGS. 2(*a*), 2(*b*) and 2(*c*) show an oblique view of an example of the thermal transfer recording ink sheet.

FIG. 2*a* shows an oblique view of an embodiments in which the thermal transfer sheet is supplied wherein each frame are arranged in order. In FIG. 2*a*, ink layers 13Y, 13M, 13C each corresponding to a yellow dye (Y), magenta dye (M) and cyan dye (C) are formed on the thermal transfer sheet 11, and a transferable image protective layer unit 14 including the protective layer capable of being peeled (in FIG. 2, a three layer structure is shown) is provided on the other area in frame order. On the other side of the support 12, a backing layer or a heat resistive sliding layer is provided.

FIG. 2*b* shows an oblique view of an example of embodiments in which the transferable image protective unit 14 is provided on a support 12' other than the support 12 on which the ink layers 13Y, 13 M and 13C are provided. Such one is one of preferable embodiments.

In FIGS. 2*a* and 2*b*, there are small spaces between each of the ink layers and the transferable image protective layer unit 14, the space may be controlled to suit the controlling system of the thermal transfer recording apparatus. A detecting mark is preferably attached on the thermal transfer sheet to raise the accuracy of the to adjusting of the ink sheets. There is no limitation on the attaching method of the detecting mark. In the above, ones are shown, in which the transferable image protective layer unit or the area for post-heating treatment is provided on the same surface of the support. However, it is allowed of course that each of the layers is separately provided on individual supports. When reactive dyes are employed in each of the ink layers, the dye contained in each ink layers is the compound before the reaction. Accordingly, these compounds are exactly not Y, M and C dyes. However, the same expression is used for convenience since the layers each for forming Y, M and C dyes.

Materials usually known as the support of the thermal transfer sheet can be employed for the support of the thermal transfer sheet. Concrete examples of the support are thin paper such as glassine paper, condenser and paraffin paper; and oriented and non-oriented film of plastics, for example, polyester resin with high thermal resistance such as polyethylene terephthalate, polyethylene naphthalate, polyphenylene sulfide, polyether ketone and polyether sulfone; propylene, fluorinated resins, polycarbonate, cellulose acetate, polyethylene derivatives, polyvinyl chloride, polyvinylidene chloride, polystyrene, polyamide, polyimide, polymethylpentene and ionomer and laminated films of these materials. The thickness of the support can be optionally selected so that the strength and the thermal resistance is made suitable, and one having the thickness of from 1 to 100 μm is preferably employed.

When the adhesiveness of the support with the ink layer formed on the surface of the support is insufficient, it is preferable to be subjected to a treatment by a primer or the corona discharge.

The ink layer constituting the thermal sheet is a thermal sublimation colorant layer containing at least a colorant and a binder.

<Colorant>

The thermal transfer sheet may have two or more colorant-containing areas different in the hue. For example, the following embodiments are cited; an embodiment in which the colorant-containing area is constituted by a yellow colorant-containing area, a magenta colorant-containing area and a cyan colorant-containing area, and a no colorant area is provided after these colorant-containing areas, an embodiment in which the colorant-containing area is constituted by a black colorant-containing area and the no-colorant containing is provided after the that, and an embodiment in which the colorant-containing area is constituted by the yellow colorant-containing area, the magenta colorant-containing area, the cyan colorant-containing area and the black colorant-containing area and the no colorant-containing area is provided after these colorant-containing areas.

As the thermal sublimation dye usable in the thermal sublimation dye layer, usual dyes employed in a thermal transfer sheet for the thermal sublimation transfer system such as azo type dyes, azomethine type dyes, methine type dyes, anthraquinone type dyes, quinophthalone type dyes and naphthoquinone type dyes can be employed without any limitation. In concrete, Holon Brilliant Yellow 6GL, PTY-52, Macrolex Yellow 6G as the yellow dye, MS Red G, Macrolex Redviolet R, Seles Red 7B, Samaron Red HBSL and SK Rubin SEGL as the red dye, and Kayaset Blue 714, Waxoline Blue AP-FW, Holon Brilliant Blue S-R, MS Blue 100 and Daito Blue No. 1 as blue dye are employable.

As the thermal diffusible dye capable of forming the chelate, various compounds can be optionally selected for use without any limitation as long as the compound can be thermally transferred. For example, the cyanine, magenta and yellow dyes described in Japanese Patent O.P.I. Publication Nos. 59-78893, 59-109349, 4-94974 and 4-97894, and Japanese Patent Examined Publication No. 2856225 are employable.

For example, compounds represented by the following Formula 1 can be employed as the chelate forming cyan dye.

Formula 1

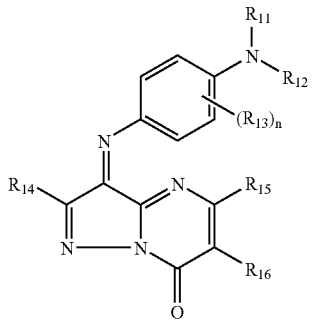

In Formula 1, $R_{11}$ and $R_{12}$ are each a substituted or an unsubstituted aliphatic group, and they may be the same as or different from each other. Examples of the aliphatic group are an alkyl group, a cycloalkyl group, an alkenyl group and alkynyl group. As the alkyl group, a methyl group, an ethyl group, a propyl group and i-propyl group are cited. Examples of the group which may be a substituent of the above alkyl groups are a straight or branched alkyl group such as a methyl group, an ethyl group, an i-propyl group, a t-butyl group, an n-dodecyl group and a 1-hexylnonyl group; a cycloalkyl group such as a cyclopropyl -group, a cyclohexyl group and a bicyclo[2,2,1]heptyl group and adamantyl group; an alkenyl group such as a 2-propylene group and oleyl group; an aryl group such as a phenyl group, an o-tolyl group, an o-anisyl group, a 1-naphthyl group and 9-anthranyl group; a heterocyclic group such as a 2-tetrahydrfuryl group, a 2-thiophenyl group, a 4-imidazolyl group and a 2-pyridyl group; a halogen atom such as a fluorine atom, a chlorine atom and a bromine atom; a cyano group; a nitro group; a hydroxyl group; a carbonyl group including an alkyl carbonyl group an acetyl group, a trifluoroacetyl group and pivaloyl group, and an arylcarbonyl group such as benzoyl group, pentafluorobenzoyl group and 3,5-di-t-butyl-4-hydroxybenzoyl group; an oxycarbonyl group including an alkoxycarbonyl group such as a methoxycarbonyl group, a cyclohexylcarbonyl group and an n-dodecyloxycarbonyl group, an aryloxycarbonyl group such as a phenoxycarbonyl group, 2,4-di-t-amylphenoxy and a 1-naphthyloxycarbonyl group, and a heterocycloxycarbonyl group such as 2-pyridyloxycarbonyl group and 1-phenylpyrazolyl-5-oxycarbonyl group; a carbamoyl group including an alkylcarbamoyl group such as a dimethylcarbamoyl group and 4-(2,4-di-t-amylphenoxy)butylaminocarbamoyl group, and an arylcarbamoyl group such as a phenylcarbamoyl group and 1-naphthylcarbamoyl group; an alkoxy group such as a methoxy group and 2-ethoxyethoxy group, an aryloxy group such as a phenoxy group, 2,4-di-t-amylphenoxy group and a 4-(4-hydroxyphenylsulfonyl)phenoxy group, and a heterocyclic oxy group such as 4-pyridyloxy group and 2-hexahydropyranyloxy group; a carbonyloxy group including an alkylcarbonyloxy group such as an acetyloxy group, a trifluoroacetyloxy group and a pivaloyloxy group, and an arylcarbonyloxy group; a urethane group including an alkylurethane group such as N,N-dimethylurethane group, and an arylurethane group such as N-phenylurethane group and N-(p-cyanophenyl)urethane; a sulfonyloxy group including an alkylsulfonyloxy group such as a methanesulfonyloxy group, a trifluoromethanesulfonyloxy group and an n-dodecanesulfonyloxy group, and an arylsulfonyloxy group such as a benzenesulfonyloxy group and a p-toluenesulfonyloxy group; an amino group including an alkylamino group such as a methylamino group, a cyclohexylamino group and an n-dodecylamino group and an arylamino group such as an anilino group and a p-t-octylanilino group; a sulfonylamino group including an alkylsulfonylamino group such as a methanesulfonylamino group, a heptafluoropropanesulfonylamino group and an n-hexadecylsulfonylamino group, and an arylsulfonylamino group such as a p-toluenesulfonylamino group and a pentaflyorobenzenesulfonylamino group; a sulfamoylamino group including an alkylsulfamoylamino group such as an N,N-dimethylsulfamoylamino group, and an arylsulfamoylamino group such as an N-phenylsulfamoylamino group; an acylamino group including an alkylcarbonylamino group such as an acetylamino group and a myristoylamino group, and an arylcarbonylamino group such as a benzoylamino group; a ureido group including an alkylureido group such as an N,N-dimethylaminoureido group, and an arylureido group such as an N-phenylureido group and an N-(p-cyanophenylureido group; a sulfonyl including an alkylsulfonyl group such as a methanesulfonyl group and a trifluoromethanesulfonyl group, and an arylsulfonyl group such as a p-toluenesulfonyl group; a sulfamoyl group including an alkylsulfamoyl group such as dimethylsulfamoyl group and a 4-(2,4-di-t-amylphenoxy)butylaminosulfamoyl group, and an arylsulfamoyl group such as a phenylsulfamoyl group; an alkylthio group such as a methylthio group and a t-octylthio group; an arylthio group such as a phenylthio group; and a heterocyclic thio group such as a 1-phenyltetrazole-5-thio group and a 5-methyl-1,3,4-oxathiazole-2-thio group.

Examples of the cycloalkyl group and the alkenyl group are the same as the above.-mentioned substituent groups, and examples of the alkynyl group are 1-propine group, 2-butine group and 1-hexine group.

A group forming a non-aromatic cyclic structure such as a pyrrolidine ring, a piperidine ring and a morpholine ring is preferable as the group represented by $R_{11}$ or $R_{12}$.

The group represented by $R_{13}$ is preferably an alkyl group, a cycloalkyl group and an acylamino group are preferable among the groups above-mentioned as the substituent. n is an integer of from 0 to 4; plural groups of $R_{13}$ may be the same as or different from each other when n is 2 or more.

$R_{14}$ is an alkyl group such as a methyl group, an ethyl group, an i-propyl group, an n-dodecyl group and a 1-hexylnonyl group. $R_{14}$ is preferably a secondary or tertiary alkyl group. Examples of the preferably secondary or tertiary alkyl group are an isopropyl group, a sec-butyl group, a tert-butyl group and a 3-heptyl group. As $R_{14}$, the isopropyl group and the tert-butyl group are most preferable. The alkyl groups represented by $R_{14}$ each may be substituted with a substituent composed of a carbon atom and a hydrogen atom; the group represented by $R_{14}$ is not substituted with a group containing any atom other than the carbon atom and the hydrogen atom.

$R_{15}$ is an alkyl group such as a methyl group, an ethyl group, an i-propyl group, an n-dodecyl group and 1-hexylnonyl group. $R_{15}$ is preferably a secondary or tertiary alkyl group. Examples of the preferably secondary or tertiary alkyl group are an isopropyl group, a sec-butyl group, a tert-butyl group and a 3-heptyl group. As $R_{15}$, the isopropyl group and the tert-butyl group are most preferable. The alkyl groups represented by $R_{15}$ each may be substituted with a substituent composed of a carbon atom and a hydrogen atom; the group represented by $R_{15}$ is not substituted with a group containing any atom other than the carbon atom and the hydrogen atom.

$R_{16}$ is an alkyl group such as n-propyl group, n-butyl group, n-pentyl group, n-hexyl group, n-heptyl group, isopropyl group, sec-butyl group, tert-butyl group and 3-heptyl group. Particularly preferable group as $R_{16}$ is a straight chain alkyl group having three or more carbon atoms. Examples of such the group are the n-propyl group, n-butyl group, n-pentyl group, n-heptyl group; and the n-propyl group and n-butyl group are most preferred. The group represented by $R_{16}$ is not substituted with a group containing any atom other than the carbon atom and the hydrogen atom.

As the chelate forming yellow dye, compounds represented by the following Formula 2 are exemplified.

Formula 2

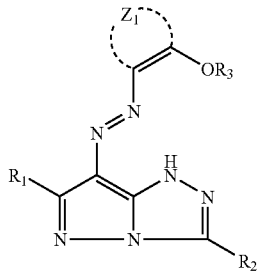

In Formula 2, $R_1$ or $R_2$ is, for example, a halogen atom, an alkyl group which has 1 through 12 carbon atoms and may be substituted with a substituent bonded through an oxygen atom, a nitrogen atom, a sulfur atom or a carbonyl group, an aryl group, an alkenyl group, an alkynyl group, a hydroxy group, an amino group, a nitro group, a carboxyl group, a cyano group, or a halogen atom. Examples of the substituent are a methyl group, an iso-propyl group, a t-butyl group, a trifluoromethyl group, a methoxymethyl group, a 2-methanesykfonylethyl group, a 2-methanesulfonamide group, a cyclohexyl group, an aryl group such as a phenyl group, a 4-t-butylphenyl group, a 3-nitophenyl group, a 3-acylaminophenyl group and a 2-methoxy, a cyano group, an alkoxyl group, an aryloxy group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, a silyloxy group, an aryloxycarbonylamino group, an imido group, a phosphonyl group and an acyl group.

An alkyl group and an aryl group represented by $R_3$ are the same as those represented by $R_1$ and $R_2$.

Examples of the 5- or 6-member aromatic ring represented by $Z_1$ constituted by together with the two carbon atoms are a ring of benzene, pyridine, pyrimidine, triazine, pyrazine, pyridazine, pyrrol, furan, thiophene, pyrazole, imidazole, triazole, oxazole and thiazole. These rings each may form a condensed ring with another aromatic ring. A substituent may be substituted on each of such the-rings. As the substituent, groups the same as those represented by $R_1$ or $R_2$ are applicable.

Compounds represented by the following Formula 3 are employable as the chelate forming magenta dye.

Formula 3

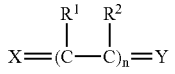

In Formula 3, X is a group or a group of atoms each capable of forming two- or more dentate chelate, Y is a group of atoms necessary to form a 5- or 6-member aromatic hydrocarbon ring or heterocyclic ring, $R^1$ and $R^2$ are each a hydrogen atom, a halogen atom or a mono-valent substituent. n is 0, 1 or 2.

Particularly preferable group represented by X is those represented by the following Formula 4.

Formula 4

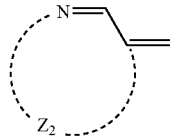

In the above formula 4, $Z_2$ is a group of atoms necessary to form an aromatic nitrogen-containing heterocyclic ring which contains at least one nitrogen atom capable of chelating. Examples of such the ring are a ring of pyridine, pyrimidine, thiazole and imidazole. These rings may be condensed to form a condensed ring with another carbon ring such as benzene ring or a heterocyclic ring such as pyridine.

In the Formula (3), Y is an atomic group forming a 5- or 6-member aromatic hydrocarbon or heterocyclic ring, which may have a substituent on the ring, or form a fussed ring. Concrete examples of such ring include a 3H-pyrrol ring, an oxazole ring, an imidazole-ring, a thiazole ring, a 3H-pyrrolidine ring, an oxazolidine ring, an imidazolidine ring, a thiazolidine ring, a 3H-indole ring, a benzoxazole ring, a benzimidazole ring, a benzothiazole ring, a quinoline ring and a pyridine ring. These rings each further may be form a condensed ring with another carbon ring such as a benzene ring or a heterocyclic ring such as a pyridine ring. The substituent on the ring may be alkyl group, aryl group, heterocyclic group, acyl group,-amino group, nitro group, cyano group, acylamino group, alkoxy group, hydroxy group, and alkoxycarbonyl group or halogen atom. These groups each further may have a substituent.

$R^1$ and $R^2$ are each a hydrogen atom, a halogen atom such as a fluorine atom and chlorine atom, or a mono-valent substituent. Examples of the mono-valent substituent include an alkyl group, an alkoxy group, a cyano group, an alkoxycarbonyl group, an aryl group, a heterocyclic group, a carbamoyl group, a hydroxy group, an acyl group, and an acylamino group.

X is a group of atoms capable of forming two- or more dentate chelate. The group of atoms may be any one as long as the group can be form a dye in Formula 3. For example, a ring of 5-pyrazolone, imidazole, pyrazolopyrrole, pyrazolopyrazole, pyrazoloimidazole, pyrazolotriazole, pyrazolotetrazole, barbituric acid, thiobarbituric acid, rhodanine, hydantoine, thiohydantoine, oxazolone, iso-oxazolone, indandione, pyrazolinedione, oxazolinedione, hydroxypyridone and pyrazolopyridone are preferred.

<Binder Resin>

The ink layer contains a binder resin together with the foregoing dye.

A binder resin of the ink layer usable in the thermal transfer sheet for usual thermal sublimation transfer system can be employed. For example, cellulose type resins such as cellulose adduct compounds, cellulose esters and cellulose ethers; polyvinyl acetal resins such as polyvinyl alcohol, polyvinyl formal, polyvinyl acetoacetal and polyvinyl butyral; polyvinyl pyrrolidone; polyvinyl acetate; polyacrylamide; styrene type resins; vinyl type resins such as poly (meth)acrylate, poly(meth)acrylic acid, (metha)acrylic acid copolymers; rubber type resins, ionomer resins, olefin type resins, and polyester resins are employable. Among them, polyvinyl butyral, polyvinyl acetoacetal and the cellulose type resins are preferable since they are superior in the storage ability.

Moreover, the following resins can be employed as the binder of the ink layer: reaction products of isocyanates with a compound having a reactive hydrogen atom selected from polyvinyl butyral, polybutyl formal, polyester polyol and acryl polyol, the foregoing reaction products in which the isocyanate is a diisocyanate or a triisocyanate, and the foregoing reaction products in which the amount of the isocyanate is from 10 to 200 parts by weight to 100 parts by weight of the compound having the reactive hydrogen atom, described in Japanese Patent Examined Publication No. 5-78437; organic solvent-soluble polymers prepared by esterization and/or urethanization of the hydroxy group in the molecular of natural and/or semi-synthesized water soluble polymer, and natural and/or semi-synthesized water-soluble polymers; cellulose acetate having an acetylation degree of not less than 2.4 and the total substituting degree of not less than 2.7 described in Japanese Patent O.P.I. publication No. 3-264393; vinyl resins such as polyvinyl alcohol (Tg=85° C.), polyvinyl acetate (Tg=32° C.), copolymer of vinyl chloride and vinyl acetate (Tg=84° C.) and polyvinyl acetoacetal (Tg=77° C.), polyvinyl acetal type resins such as polyvinyl butyral (Tg=84° C.) and polyvinyl acetal (Tg=110° C.), vinyl type resins such as polyacrylamide(Tg=165° C.), and polyester resins such as aliphatic polyester (Tg=130° C.); reaction products of isocyanates with polvinyl butyral) containing from 15 to 40% by weight of vinyl alcohol moiety and those in which the isocyanate is a di-isocyanate or a triisocyanate, resins described in Japanese Patent O.P.I. Publication No. 7-52564; phenylisocyanate-modified polyvinyl acetal resins represented by Formula (I) described in Japanese Patent O.P.I. Publication No. 7-32742; hardened products of a composition containing one of an isocyanate reactive cellulose and an isocyanate reactive acetal resin, and one resin selected from a isocyanate reactive acetal resins, isocyanate reactive vinyl resins, isocyanate reactive acryl resins, isocyanate reactive phenoxy resins and isocyanate reactive styrol resins, described in Japanese Patent O.P.I. Publication No. 6-155935; polyvinyl butyral resins having a molecular weight of not less than 60,000 and a glass transition point of not less than 60° C., and more preferably from 70° C. to 110° C., and the ratio of vinyl alcohol in the polyvinyl butyral resin is from 10 to 40%, and more preferably from 15 to 30%, by weight; and acryl-modified cellulose resins in which ethyl cellulose, hydroxyethyl cellulose, ethylhydroxy cellulose, hydroxypropyl cellulose, methyl cellulose, cellulose acetate and cellulose lactate-acetate, and preferably ethyl cellulose, can be employed as the cellulose type resin.

The above-mentioned various binder resins may be employed singly or in combination of two or more kinds.

In the ink layer various additives may be added according to necessity additionally to the foregoing dye and binder resin. The ink layer can be formed, for example, by coating and drying a coating liquid in which the dye, binder resin, and another additive are dispersed or dissolved in a suitable solvent by a known means such as a gravure coating method on the support. The thickness of the ink layer may be from 0.1 to 3.0 μm, and preferably from 0.3 to 1.5 μm.

Thermal Resistive Sliding Layer

In the thermal transfer sheet a thermal resistive sliding layer may be provided on the surface of the support opposite to the surface on which the ink layer is provided.

The purpose of the thermal resistive sliding layer is to prevent the thermal adhesion by fusion of the support and the heating device such as the heating head, to smoothly run of the sheet and to remove the materials adhered on the thermal head.

As the resin to be used in the thermal resistive sliding layer, for example, cellulose type resins such as ethyl cellulose, hydroxy cellulose, hydroxypropyl cellulose, methyl cellulose, cellulose acetate, cellulose lactate-acetate and nitro cellulose; vinyl type resins such as polyvinyl alcohol, polyvinyl acetate, polyvinyl butyral, polyvinyl acetal and polyvinyl pyrrolidone; acryl type resins such as polymethyl methacrylate, polyethyl acrylate, polyacrylamide and acrylonitrile-styrene copolymer; natural or synthesized resins such as polyimide resin, polyamide resin, polyamidoimide resin, polyvinyltoluene resin, chromanindene resin, polyester type resins, polyurethane resin, and silicone-modified and fluorine-modified urethane resins; are employed singly or in a mixture thereof. It is preferable that the resin having a reactive hydroxy group is used from the foregoing resins together with a crosslinking agent such as polyisocyanate to make the layer to a crosslinked layer for further raising the thermal resistivity of the thermal resistive sliding layer.

Moreover, a solid or liquid parting agent or a sliding agent may be added to the thermal resistive sliding layer to giving sliding ability from the thermal head. As the parting agent or the sliding agent, for example, various waxes such as a polyethylene wax and paraffin wax, an aliphatic higher alcohol, an organopolysiloxane, an anionic surfactant, a cationic surfactant, an amphoteric surfactant, a nonionic surfactant, a fluorinated surfactant, a metal soap, an organic carboxylic acid and its derivative, a fluorinated resin, a silicone resin, and an inorganic fine particle such as talk and silica are employable. The amount of the sliding agent contained in the thermal resistive sliding layer is from 5 to 50%, and preferably about from 10 to 30%, by weight. The thickness of the thermal resistive sliding layer may be about from 0.1 to 10 μm, and preferably about from 0.3 to 5 μm.

When the protective layer transfer unit is a piled element of the transferable protective layer and the adhering layer, the effect of the adhering layer is to make easier the transfer of the protective layer to the subjective receiving material. As the adhesive agent constituting the adhering layer, thermally fusible resins such as acryl resins, styrene-acryl copolymers, vinyl chloride resins, styrene-vinyl chloride-vinyl acetate copolymers and vinyl chloride-vinyl acetate copolymers can be used. The adhering layer can be formed by known means such as gravure coating, gravure reverse coating and roller coating, and the thickness of the adhering layer is preferably about from 0.1 to 5 μm.

<Thermal Transfer Image Receiving Sheet>

The thermal transfer image receiving sheet at least having a thermal diffusible dye receiving layer is described below.

(Support)

The support to be employed in the thermal transfer image receiving sheet has a role to support the thermal diffusible dye image receiving layer and further preferably to has sufficient mechanical strength for handling in excessively heated state since the image receiving sheet is heated on the occasion of the transfer.

The followings are employable as a material of the support: condenser paper, glassine paper, sulfate paper, highly sized paper, synthesized paper (polyolefin type and polystyrene type), high quality paper, art paper, coated paper, cast coated paper, wall paper, lining paper, synthesized resin- or emulsion-impregnated paper, synthesized rubber latex-impregnated paper, synthesized resin including paper, cardboard paper, cellulose fiber paper, and a film of polyester, polyacrylate, polycarbonate, polyurethane, polyimide, polyether imide, cellulose derivative, polyethylene, ethylene-vinyl acetate copolymer, polypropylene, polystyrene, polyacryl, polyvinyl chloride, polyvinylidene chloride, polyvinyl alcohol, polyvinyl butyral, Nylon, Polyether ether ketone, polysulfone, polyether sulfone, tetrafluoroethylene, tetrafluoroethylene, perfluoroalkyl vinyl ether, polyvinyl fluoride, tetrafluoroethylene-ethylene, tetrafluoroethylene-hexafluoropropylene, polychlorotrifluoroethylene, and polyvinylidene fluoride. White opaque film formed by such the resin added with white pigment or filler, or foamed sheet formed by foaming the resin sheet can be employed.

A laminate sheet by optional combination of the foregoing support may be employed. As typical examples of the laminated support, cellulose fiber paper and synthesized paper or cellulose synthesized paper and plastic film can be cited. The thickness of the support may be optionally decided, and is usually about from 10 to 300 μm.

The presence of a layer having fine voids is preferable to obtain high printing sensitivity and high image quality without density unevenness and white image lacking. As the layer having the fine voids, plastic film and synthesized paper each having voids therein are usable. The voids having layer may be formed on the various supports by various coating methods. The plastic film and the synthesized paper are preferable which are prepared by expanding and film forming of a mixture mainly comprised of polyolefin, particularly polypropylene, blended with inorganic pigment and/or polymer incompatible with the polypropylene as foam forming agents. The sheet principally comprising the polypropylene is preferred.

Considering such the facts, the elasticity of the plastic film and the synthesized paper is preferably from $5\times10^8$ Pa to $1\times10^{10}$ Pa at 20° C. The plastic film and the synthesized paper are usually formed by a two-axis expanding method. Consequently, they are shrunk by heating. The shrinking ratio is from 0.5 to 2.5% when the sheet is stood for 60 seconds at 110° C., The plastic film and the synthesized paper may be single layer containing fine voids in itself or laminated plural layers. When the plural layer constitution, it is allowed that the entire layers include the fine voids or a layer including no void may be contained in the plural layers. White pigment may be added as a masking agent into the plastic film and the synthesized paper. A fluorescent whitening agent may be added to increase the whiteness. The thickness of the layer including the fine voids is preferably from 30 to 80 μm.

The layer including the fine voids may be formed by coating on the support. Known resins such as polyester resins, urethane resins, polycarbonate resins, acryl resins, polyvinyl chloride and poly vinyl acetate may be employed singly or in combination of plural kinds thereof.

A layer of polyvinyl alcohol, polyvinylidene chloride, modified polyolefin, polyethylene phthalate or polycarbonate may be provided for preventing the curling on the side of the base support opposite to the side on which the image receiving layer is provided. As the laminating method, for example, known methods such as a dry lamination method, a non-solvent (hot melt) lamination method and an EC lamination method are employable, and the dry lamination method and the non-solvent lamination method are preferable. Example of the adhesive suitable for the non-solvent lamination is Taconite 720L, manufactured by Takeda Yakuhin Kogyo Co., Ltd., and that suitable for dry lamination method are Takelack A969/Takenate A-5 (3/1), manufactured by Takeda Pharmaceutical Co., Ltd., and Polyzol SPA SE-1400 and Vinylol PSA AV-6200 series, manufactured by Showa Highpolymer Co., Ltd. The using amount of the adhesive is about from 1 to 8 g/m$^2$, and more preferably from 2 to 6 g/m$^2$.

The plastic film and the synthesized paper, the plastic films with together, the synthesized paper sheets with together, or the various kinds of paper and the plastic film can be laminated by the use of an adhesive layer.

It is preferable that the support surface is subjected to a various kinds of primer treatment or a corona discharge treatment for raising the adhering strength between the support and the thermal diffusible dye receiving layer.

(Binder Resin)

Known binder resins may be employed in the thermal transfer image receiving sheet, and easily dyable ones are preferred among them. In concrete, polyolefin resins such as polypropylene, halogenated resins such as poly vinyl chloride and poly vinylidene chloride, vinyl type resins such as poly vinyl acetate and polyacrylate, polyester resins such as poly ethylene terephthalate and poly butylene terephthalate, polystyrene type resins, polyamide type resins, phenoxy resins, copolymers of an olefin such as ethylene and propylene with anther vinyl type monomer, polyurethane resins, polycarbonate resins, acryl resins, ionomers, cellulose derivatives are usable singly or in combination. Among them, the polyester resins, vinyl type resins and the cellulose derivatives are preferred.

(Parting Agent)

It is preferable to add a parting agent into the thermal diffusible dye receiving layer to prevent the adhesion by thermal fusion of the thermal diffusible dye receiving layer with the thermal transfer sheet. Phosphate type plasticizers, fluorinated compounds and silicone oil including reaction hardenable silicone are usable as the parting agent, and the silicone oil is preferred among them. As the silicone oil, various kinds of modified silicone oil such as dimethylsilicone. In concrete, amino-modified silicone, epoxy-modified silicone, alcohol-modified silicone, and urethane-modified silicone are employed. They may be blended or polymerized by various methods for using. The adding amount of the parting agent is preferably from 0.5 to 30 parts by weight to 100 parts by weight of the binder resin for constituting the dye image receiving layer. When the range of the adding amount is not satisfied, the fusion adhesion of the thermal transfer sheet with the dye image receiving layer of the thermal transfer image receiving sheet and the decreasing of the printing sensitivity occur some times. This parting agent may be separately provided, not added into the dye receiving layer, in a form of a parting layer on the thermal diffusible image receiving layer.

(Metal Ion Compound)

It is preferable that the thermal diffusible dye receiving layer contains the metal ion-containing compound the same as those to be added to the resin layer of the transferable image protective layer unit.

(Intermediate Layer)

In the thermal transferable image receiving sheet, an intermediate layer may be provided between the support and the thermal diffusible dye receiving layer. The under layer is whole layers arranged between the support and the thermal diffusible dye receiving layer, which may have a multi-layer constitution. Though the function of the intermediate layer is to provide a solvent resistive ability, a barrier ability, whiteness giving ability, a masking ability and an anti-static ability, the function is not limited to the above functions, and known intermediate layers can be entirely applied.

For providing the solvent resistive ability and the barrier ability-to the intermediate layer, water-soluble resins are preferably employed. As the water-soluble resin, cellulose type resins such as carboxymethyl cellulose, polysaccharide type resins such as starch, proteins such as casein, gelatin, agar, vinyl type resins such as polyvinyl alcohol, ethylene-vinyl acetate copolymer, polyvinyl acetate, vinyl chloride-vinyl acetate copolymer such as Veova manufactured by Japan Epoxy-resin Co., Ltd., vinyl acetate-methacryl copolymer, methacryl resins, styrene-methacryl copolymer and styrene resin, polyamide type resins such as melamine resin, urea resin and benzoguanamine resin, polyester resin and polyurethane resin are applicable. The water-soluble resin is a resin capable of being completely dissolved (particle diameter of not more than 0.01 mm), dispersed as a colloidal dispersion (particle diameter of from 0.01 to 0.1 μm), dispersed in an emulsion state (particle diameter of from 0.1 to 1 μm) or in a slurry state (more than 1 μm) in a solvent principally composed of water. Among such the water-soluble resins, ones not only insoluble but also non-swellable in usual organic solvent, for example, alcohols such as methanol, ethanol and iso-propyl alcohol, hexane, cyclohexane, acetone, methyl ethyl ketone, xylene, ethyl acetate, butyl acetate and toluene, are particularly preferred. The resins capable of completely being dissolved in the solvent principally composed of water are particularly preferred. The poly vinyl alcohol resins and cellulose resins are particularly preferred.

For giving adhesion ability to the intermediate layer, urethane type resins and polyolefin type resins are usually employed even though the resins may be changed according to the kind and the surface treatment of the support. Sufficient adhesion ability can be obtained by the use of a thermoplastic resin having an active hydrogen atom together with a hardening agent such as isocyanate compounds. For giving the whiteness giving ability to the intermediate layer, a fluorescent whitening agent can be employed. As the fluorescent whitening agent, any compounds known as the whitening agent can be employed, and the fluorescent whitening agents of stilbene type, di-stilbene type, benzoxazole type, styryl-benzoxazole type, pyrene-oxazole type, coumalin type, aminocoumalin type, imidazole type, benzimidazole type, pyrazoline type and distyryl-biphenyl type are usable. The whiteness can be controlled by controlling the kind and the adding amount of the whitening agent. Any methods can be applied for adding the fluorescent whitening agent. A method in which the whitening agent is dissolved in water, a method in which the whitening agent is crushed and dispersed by a ball mill or a colloid mill, a method in which the whitening agent is dissolved in a high-boiling solvent and mixed with a hydrophilic colloid solution to make as a oil in water type dispersion and a method in which the whitening agent is impregnated in a polymer latex, are applicable.

Moreover, titanium oxide may be added to the intermediate layer to conceal the glaringness and the unevenness of the support. The use of the titanium oxide is preferable since the degree of freedom of selection of the support can be made wider. Though the titanium oxide includes rutile-type titanium oxide and anatase type titanium oxide, anatase-type titanium oxide is preferable considering the whiteness and the effect of the fluorescent whitening agent since the UV absorption of the anatase-type titanium oxide is in shorter wavelength region than that of the rutile-type titanium oxide. When the binder resin of the intermediate layer is an aqueous system and the titanium oxide is difficultly dispersed therein, the dispersing can be made possible by the use of the titanium oxide subjected to a hydrophilization treatment on the surface or by the use of known dispersing agent such as a surfactant and ethylene glycol. The adding amount of the titanium oxide is preferably from 10 to 400 parts by weight in terms of the solid component of titanium oxide to 100 parts by weight of the solid component of resin.

For providing the anti-static ability to the intermediate layer, materials such as an electroconductive inorganic filler and an organic electroconductive material such as polyanilinesulfonic acid can be suitably selected corresponding to the binder resin of the intermediate layer. The thickness of the intermediate layer is preferably about within the range of from 0.1 to 10 μm.

<Image Forming Method>

Figure 3:
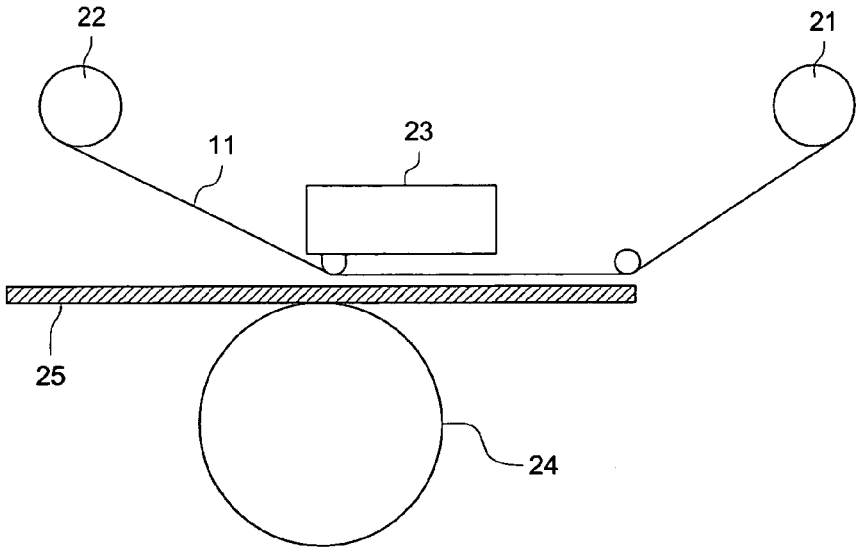
FIG. 3 shows a schematic illustration of an example of the thermal transfer recording apparatus usable in the invention.

As the thermal transfer recording apparatus usable in the image forming method, for example, the thermal transfer recording apparatus shown in FIG. 3 can be employed. In FIG. 3, 21 is a supplying roller for supplying the thermal transfer sheet, 11 is a thermal transfer sheet, 22 is a winding up roller for winding up the used thermal transfer sheet, 23 is a thermal head, 24 is a platen roller, 1 is a thermal transfer image receiving sheet inserted between the thermal head 23 and the platen roller 24.

The process of image formation is described in which the thermal transfer recording apparatus shown in FIG. 3 and the thermal transfer sheet shown in FIG. 2*a* are employed. The thermal transfer sheet has the image protective layer unit and also functions as the protective layer transfer sheet. Firstly, the ink layer 13 Y containing the yellow dye is overlapped with the image receiving layer of the thermal transfer image receiving sheet 25 and the yellow dye in the ink layer 13Y is transferred to image receiving sheet by heating by the thermal head 23 according to the image data to form a yellow image, and then the magenta dye is imagewise transferred in the same manner on the yellow image from the ink layer 13M containing the magenta dye. After that, the cyan dye is imagewise transferred in the same manner on the above image from the ink layer 13C containing the cyan dye, and finally, the transferable protective layer unit 14 containing the transferable protective layer is uniformly transferred onto the image from the thermal transfer sheet to complete the image formation.

EXAMPLES

The invention is described referring examples. In the examples "part" and "%" are each "part by weight" and "percent by weight", respectively, as long as any specific comment is not attached.

Example 1

<<Preparation of Protective Layer Transfer Sheet>>

<Preparation of Protective Layer Transfer Sheet 1>

(Preparation of Support A Having a Back Coat Layer)

Back Coating Layer Coating Liquid 1 having the following composition was coated by a gravure coating method on 6 μm poly ethylene terephthalate film, manufactured by Toray Co., Ltd., and then hardened by heating to prepare Support A having a backing layer having a dry thickness of 1.0 μm.

| <Preparation of Back Coat Coating Liquid 1> | |
|---|---|
| Polyvinyl butyral resin, S-LEC BX-1 (Sekisui Kagaku Kogyo Co., Ltd.) | 3.5 parts |
| Phosphate type surfactant, Plysurf A208S (Daiichi Kogyo Seiyaku Co., Ltd.) | 3.0 parts |
| Phosphate type surfactant, PHOSPHANOL RD 720 (Toho Chemical Industry Co., Ltd.) | 0.3 parts |
| Polyisocyanate, Barnoc D750-45 (Dainippon Ink and Chemicals, Incorporated) | 19.0 parts |
| Talc, Y/X = 0.03 (Nippon Talc Co., Ltd.) | 0.2 parts |
| Methyl ethyl ketone | 35.0 parts |
| Toluene | 35.0 parts |

(Formation of First Resin Layer 1)

The following First Resin Layer Coating Liquid 1 containing the UV absorbent was coated on the surface of Support A by a wire bar coating method and dried so as to form a layer having a dry thickness of 2.0 μm.

| <Preparation of First Resin Layer Coating Liquid 1> | |
|---|---|
| Acryl resin, Dianal BR83 (Mitsubishi Rayon Co., Ltd.) | 6.0 parts |
| UV absorbing resin, UVA635L (BASF Co., Ltd.) | 2.0 parts |
| Methyl ethyl ketone | 50.0 parts |

(Formation of Barrier Layer 1)

The following Barrier Layer Coating Liquid 1 was coated on the surface of First Resin Layer containing the UV absorbent by the wire bar coating method and dried so as to form a layer having a dry thickness of 2.0 μm.

| <Preparation of Barrier Layer Coating Liquid 1> | |
|---|---|
| Acryl resin, Dianal BR83 (Mitsubishi Rayon Co., Ltd.) | 8.0 parts |
| Methyl ethyl ketone | 50.0 parts |

(Formation of Second Resin Layer 1)

Then the following Second Resin Layer Coating Liquid 1 containing the metal ion-containing compound was coated on Barrier Layer by a wire bar coating method and dried so as to form a layer having a dry thickness of 2.0 μm. Thus Protective layer transfer sheet 1 was prepared.

| <Preparation of Second Resin Layer Coating Liquid 1> | |
|---|---|
| Acryl resin, Dianal BR-90 (Mitsubishi Rayon Co., Ltd.) | 6.0 parts |
| Metal ion-containing compound, MS-1* | 2.0 parts |
| Methyl ethyl ketone | 50.0 parts |

MS-1*: $Nl^{2+}[C_7H_{15}COC(COOCH_3)=C(CH_3)O^-]_2$

Preparation of Protective Layer Transfer Sheet 2

Protective Layer Transfer Sheet 2 was prepared in the same manner as in Protective Layer Transfer Sheet 1 except that the following Barrier Layer Coating Liquid 2 was employed in place of Barrier Layer Coating Liquid 1.

| <Preparation Barrier Layer Coating Liquid 2> | |
|---|---|
| Vinyl chloride-vinyl acetate copolymer, #1000ALK (Denki Kagaku Kogyo Co., Ltd.) | 8.0 parts |
| Methyl ethyl ketone | 50.0 parts |

Preparation of Protective Layer Transfer Sheet 3

Protective Layer Transfer Sheet 3 was prepared in the same manner as in Protective Layer Transfer Sheet 1 except that the following Barrier Layer Coating Liquid 3 was employed in place of Barrier Layer Coating Liquid 1.

| <Preparation Barrier Layer Coating Liquid 3> | |
|---|---|
| Polyvinyl butyral, BX-1 (SEKISUI CHEMICAL Co., LTD..) | 8.0 parts |
| Methyl ethyl ketone | 50.0 parts |

Preparation of Protective Layer Transfer Sheets 4 through 8

Protective layer transfer sheets 4 through 8 were prepared in the same manner as in Protective Layer Transfer Sheet 1 except that the thickness of the barrier layer was changed to 0.5 μm, 4.0 μm, 6.0 μm and 12.0 μm, respectively.

Preparation of Protective Layer Transfer Sheets 9 through 14

Protective Layer Transfer Sheets 9 through 14 were prepard in the same manner as in Protective Layer Transfer Sheet 1 except that Second Resin Coating Liquids 2 through 7 each containing the metal ion-containing compound described in Table 1 were each coated in place of Second Resin layer Coating Liquid 1, respectively.

TABLE 1

| Protective layer transfer sheet | Second resin layer coating liquid | Second resin layer coating liquid composition (parts) | | |
|---|---|---|---|---|
| | | Acryl resin (DB90) | Metal ion-containing compound (MS-1) | Methyl ethyl ketone |
| 9 | 2 | 9.95 | 0.05 | 60.0 |
| 10 | 3 | 9.5 | 0.5 | 60.0 |
| 11 | 4 | 8.5 | 1.5 | 60.0 |
| 12 | 5 | 5.0 | 5.0 | 60.0 |
| 13 | 6 | 2.5 | 7.5 | 60.0 |
| 14 | 7 | 1.5 | 8.5 | 60.0 |

DB90: Acryl resin, Dianal BR90 (Mitsubishi Rayon Co., Ltd.)

Preparation of Protective Layer Transfer Sheets 15 through 32

Protective Layer Transfer Sheets 15 through 32 were prepared in the same manner as in Protective Layer Transfer Sheet 1 except that First Resin Layer Coating Liquids 2 through 19 were each employed in place of First Resin Layer coating Liquids 1, respectively.

TABLE 2

| Protective layer sheet | First resin layer | First resin layer coating liquid composition (part) | | | | | |
|---|---|---|---|---|---|---|---|
| | | Acryl resin | | UV absorbing resin | UV absorbent | | Methyl ethyl |
| No. | No. | (DB90) | (BR83) | (*1) | T-320 | IT-UD | ketone |
| 15 | 2 | 0.05 | — | 9.95 | — | — | 60.0 |
| 16 | 3 | 0.3 | — | 9.7 | — | — | 60.0 |
| 17 | 4 | 1.0 | — | 9.0 | — | — | 60.0 |
| 18 | 5 | 5.5 | — | 4.5 | — | — | 60.0 |
| 19 | 6 | 6.5 | — | 3.5 | — | — | 60.0 |
| 20 | 7 | 9.98 | — | 0.02 | — | — | 60.0 |
| 21 | 8 | — | 0.05 | — | 9.95 | — | 60.0 |
| 22 | 9 | — | 1.0 | — | 9.0 | — | 60.0 |
| 23 | 10 | — | 2.5 | — | 7.5 | — | 60.0 |
| 24 | 11 | — | 4.0 | — | 6.0 | — | 60.0 |
| 25 | 12 | — | 6.0 | — | 4.0 | — | 60.0 |
| 26 | 13 | — | 9.98 | — | 0.02 | — | 60.0 |
| 27 | 14 | — | 0.05 | — | — | 9.95 | 60.0 |
| 28 | 15 | — | 1.0 | — | — | 9.0 | 60.0 |
| 29 | 16 | — | 2.5 | — | — | 7.5 | 60.0 |
| 30 | 17 | — | 4.0 | — | — | 6.0 | 60.0 |
| 31 | 18 | — | 6.0 | — | — | 4.0 | 60.0 |
| 32 | 19 | — | 9.98 | — | — | 0.02 | 60.0 |

DB90: Acryl resin, Dianal BR90 (Mitsubishi Rayon Co., Ltd.)
DB83: Acryl resin, Dianal BR83 (Mitsubishi Rayon Co., Ltd.)
*1: UV absorbing resin, UVA635L (BASF Co., Ltd.)
T-320: Tinuvin 320 (Ciba-Geigy Ltd.)
IT-UD: Titanium oxide, Idemitsu Titania IT-UD (Idemitsu Kosan Co., Ltd.)

Preparation of Protective Layer Transfer Sheet 33

Protective Layer Transfer Sheet 33 was prepared in the same manner as in Protective Layer Transfer Sheet 1 except that Adhering Layer Coating Liquid 1 having the following composition was coated on Second Resin Layer 1 and dried so that the layer thickness was 1.0 μm.

| Preparation of Adhering Layer Coating Liquid 1 | |
|---|---|
| Vinyl chloride-vinyl acetate copolymer, #1000ALK (Denki Kagaku Kogyo Kabushiki Kaisha) | 8.0 parts |
| Methyl ethyl ketone | 50.0 parts |

[Preparation of Protective Layer Transfer Sheet 34]

Parting Layer Coating Liquid 1 having the following composition was coated on Support A and dried so as to form Parting Layer 1 having a dried layer thickness of 1.0 μm. Thereafter, First Resin Layer 1, Barrier Layer 1, Second Resin Layer 1 were successively provided in the same manner as in Protective Layer Transfer Sheet 1 to prepare Protective Layer Transfer Sheet 34.

| Preparation of Parting Layer Coating Liquid | |
|---|---|
| Polyurethane resin, Hydran AP-40 (Dainippon Ink and Chemicals, Incorporated) | 5.0 parts |
| Polyvinyl alcohol resin, GOHSENOL C500 (Nippon Synthetic Chemical Industry Co., Ltd.) | 8.0 parts |
| Water | 80.0 parts |
| Ethanol | 80.0 parts |

Thus Protective Layer Transfer Sheets 1 through 34 according to the invention were prepared as above-described.

Preparation of Protective Layer Transfer Sheet 35:

Comparative Example

A comparative Protective Layer Transfer Sheet 35 was prepared in the same manner as in Protective Layer Transfer Sheet 1 except that Barrier-Layer 1 was omitted.

Preparation of Protective Layer Transfer Sheet 36:

Comparative Example

A comparative Protective Layer Transfer Sheet 36 was prepared in the same manner as in Protective Layer Transfer Sheet 1 except that the metal ion-containing compound MS-1 was eliminated from Second Resin Layer 1 containing the metal ion-containing compound.

Preparation of Protective Layer Transfer Sheet 37:

Comparative Example

A comparative Protective Layer Transfer Sheet 37 was prepared in the same manner as in Protective Layer Transfer Sheet 1 except that the UV absorbent (UVA635L) was eliminated from Second Resin layer 1 containing the UV absorbent.

Preparation of Protective Layer Transfer Sheet 38:

Comparative Example

Comparative Protective Layer Transfer Sheet 38 was prepared in the same manner as in Protective Layer Transfer Sheet 1 except that the metal ion-containing compound MS-1 was eliminated from Second resin Layer 1 containing the metal ion-containing compound and the UV absorbent (UVA635L) was eliminated from First resin Layer 1 containing the UV absorvent.

Preparation of Protective Layer Transfer Sheets 39 through 42:

Comparative Example

Comparative Protective Layer Transfer Sheets 39 through 42 each having a single protective layer were prepared by coating each of Transferable Protective Layer Coating Liquids 1 through 4 listed in Table 3 on Support A and dried so as to layer having a dry thickness of 1.0 μm.

TABLE 3

| Protective layer transfer sheet No. | Transferable protective layer coating liquid No. | Transferable protective layer (single layer) coating liquid composition (part) | | | |
|---|---|---|---|---|---|
| | | Acryl resin (DB90) | UV absorbent (*1) | Metal ion-containing compound (MS-1) | Methyl ethyl ketone |
| 39 | 1 | 5.0 | 2.5 | 2.5 | 60.0 |
| 40 | 2 | 7.5 | 2.5 | — | 60.0 |
| 41 | 3 | 7.5 | — | 2.5 | 60.0 |
| 42 | 4 | 10.0 | — | — | 60.0 |

DB90: Acryl resin, Dianal BR90 (Mitsubishi Rayon Co., Ltd.)
*1: UV absorbing resin UVA635L (BASF Co., Ltd.)

<<Preparation of Thermal Transfer Sheet>>

Thermal Transfer Sheet 1 was obtained by coating an image receiving layer coating liquid having the following composition on one side of synthesized paper support having a thickness of 150 μm (Yupo FPG-150, Yupo Corporation) so that the coated amount of solid component was 4 g/m$^2$, and dried for 30 seconds at 110° C.

| (Preparation of the image receiving layer coating liquid) | |
|---|---|
| Polyvinyl butyral resin, S-LEC BX-1 (SEKISUI CHEMICAL Co., LTD.) | 4.5 parts |
| Metal ion-containing compound, MS-1 (above described) | 3.0 parts |
| Methyl-styryl-modified silicone oil, KF410 (Shin-Etsu Chemical Co., Ltd.) | 0.5 parts |
| Methyl ethyl ketone | 80.0 parts |
| Butyl lactate | 10.0 parts |

<<Preparation of Thermal Transfer Ink Sheet>>

Preparation of Thermal Transfer Ink Sheet 1

(Coating of Back Coat Layer)

Polyethylene phthalate film having a thickness of 6 μm, K-203E-6F, manufactured by Mitsubishi Polyester Film L,L,C., was employed as the support, on one side of which an adhesive treatment was provided. Back Coat Layer Coating Liquid 1 the same as that in the foregoing protective layer transfer sheet was coated by a gravure coating method on the -side of the support opposite to the adhesive treated side and dried and subjected to a hardening treatment by heat so as to obtain Support B for the thermal transfer ink sheet having the back coat layer.

(Formation of Ink Layers)

A yellow ink coating liquid, a magenta ink coating layer and a cyan ink coating layer-coating liquid each for forming a yellow (Y), magenta (M) and cyan (C) ink layer were coated by the gravure coating method in the frame order on the side of Support B opposite to the side on which the back coat layer was provided and dried and subjected to hardening treatment to prepare Thermal Ink Transfer Sheet 1 having the constitution displayed in FIG. 2*b*. The thickness of each of the ink layers was 0.8 μm.

| | |
|---|---|
| <Yellow ink coating liquid> | |
| Post-chelate dye Y-1 | 4.5 parts |
| Polyvinyl acetoacetal resin, S-LEC KS-5 (SEKISUI CHEMICAL Co., LTD..) | 5.0 parts |
| Urethane-modified silicone resin, Diaromer SP-2105 (Dainichiseika Color & Chemicals Mfg. Co., Ltd.) | 0.5 parts |
| Methyl ethyl ketone | 45.0 parts |
| Toluene | 45.0 parts |
| <Magenta ink coating liquid> | |
| Post-chelate dye M-1 | 4.0 parts |
| Polyvinyl acetoacetal resin, 3-LEC KS-5 (SEKISUI CHEMICAL Co., LTD..) | 5.5 parts |
| Urethane-modified silicone resin, Diaromer SP-2105 (Dainichiseika Color & Chemicals Mfg. Co., Ltd..) | 0.5 parts |
| Methyl ethyl ketone | 45.0 parts |
| Toluene | 45.0 parts |
| <Cyan ink coating liquid> | |
| Post-chelate dye C-1 | 4.0 parts |
| Polyvinyl acetoacetal resin, S-LEC KS-5 (SEKISUI CHEMICAL Co., LTD..) | 5.5 parts |
| Urethane-modified silicone resin, Diaromer SP-2105 (Dainichiseika Color & Chemicals Mfg. Co., Ltd.) | 0.5 parts |
| Methyl ethyl ketone | 45.0 parts |
| Toluene | 45.0 parts |

Y-1

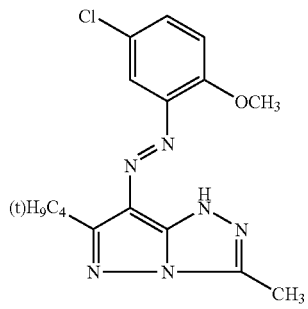

M-1

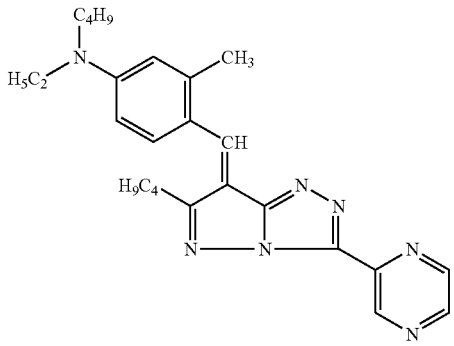

-continued

C-1

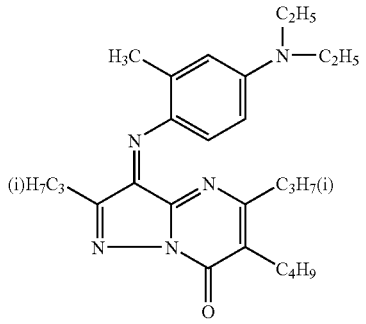

Preparation of Thermal Transfer Ink Sheet 2

Thermal Transfer Ink Sheet 2 having the constitution displayed in FIG. 1*a* was prepared by coating the above-prepared yellow ink coating liquid, magenta ink coating liquid and cyan ink coating liquid, and the protective layer transfer unit in the frame order by the gravure coating method and dried. The structure of the transferable protective layer was the same as that foregoing Protective Transfer Sheet 34, and the parting layer having thickness of 1 μm, the first resin layer containing the UV absorbent having thickness of 2 μm, the barrier layer having thickness of 2 μm and the second resin layer containing the metal ion-containing compound having thickness of 2 μm were multi-layered in this order from the support. The thickness of each of the ink layers was 0.8 μm.

<<Image Formation>>

The image receiving portion of the thermal transfer image receiving sheet and the ink layer of the thermal transfer sheet were set so as to overlap with each other on the thermal recording apparatus, in which a thermal head having square shape of 80 μm in the main scanning direction by 120 μm in the sub-scanning direction and 300 dpi (dpi is the dot number per 2.54 cm) line head was installed. The sheets were heated from the back side of the ink layer by a step pattern of successively increased from 5 to 80 m/mm$^2$ for each of colors of yellow, magenta, cyan and neutral, which was formed by overlapping of the yellow, magenta, and cyan, while pressing the sheets by the thermal head and the platen roller in a conveying rate of 10 millisecond/line and a conveying length of 85 μm per line to transfer each of the dyes onto the image receiving layer. Thus images were formed.

After that, using the thermal recording apparatus the same as that used for the image formation, the image receiving sheet on which the images were transferred was overlaid with each of the Protective Layer Transfer Sheets 1 through 42 and the protective layer was uniformly transferred onto the images on the image receiving sheet by heating from back side of the protective layer transfer sheet by applying energy of 60 mj/mm$^2$ in a conveying rate of 10 msec/line while pressing by the thermal head and the platen roller to prepare Images 1 through 42, respectively.

In the case of Protective Layer Transfer Sheet 34, it was confirmed that the parting layer was remained on Support A after the transfer and the other layers (the first resin layer containing the UV absorbent, the barrier layer, the second resin layer containing the metal ion-containing compound) were transferred onto the image surface, and regarding to the outer protective layer transfer sheets the image protective layer unit was entirely transferred onto the image surface.

Thereafter, Image 43 was prepared by transferring the ink layer of yellow, magenta, cyan and transferable protective layer were successively transferred by employing the foregoing thermal recording apparatus and Thermal Transfer Sheet 2 having the structure of FIG. 2*a* in which the image protective layer unit and ink layers were arranged in frame order.

<<Evaluation of the Formed Image>>

The images formed as above were subjected to the following evaluations.

(Evaluation on the Printed Image Density)

The reflective optical density of the maximum density portion of the neutral colored image pattern was measured by a densitometer X-rite 310, and evaluated according to the following norm.

A: The maximum density was not less than 2.2

B: The maximum density was not less than 2.1 and less than 2.2.

C: The maximum density was not less than 1.9 and less than 2.1.

D: The maximum density was less than 1.9.

(Evaluation on the White Background)

The reflective optical density (density through the blue filter) of the white background portion of the formed image was measured by a densitometer X-rite 310, and evaluated according to the following norm.

A: The density of the white background was less than 0.01.

B: The density of the white background was not less than 0.01 and less than 0.03.

C: The density of the white background was not less than 0.03 and less than 0.1.

D: The density of the white background was not less than 0.1.

(Density Variation of the White Background)

The printed images were each stored for one month in a thermo-hygrostat at 60° C. and 80% RH, and the reflective optical density (through the blue filter) of the white background portion was measured by X-rite 310. The difference between the white black ground density before the storage was calculated and the variation of the white back ground density were evaluated according to the following norm.

A: The variation of the density of the white background was less than 0.05.

B: The variation of the density of the white background was not less than 0.05 and less than 0.1.

C: The variation of the density of the white background was not less than 0.1 and less than 0.2.

D: The variation of the density of the white background was not less than 0.2.

(Evaluation on the Spreading Resistivity if the Image)

The printed images were each stored for one month in a thermo-hygrostat at 60° C. and 80% RH, and the edge of the maximum density portion of the neutral colored image was visually observed and the spreading resisitivity of the image was evaluated according to the following norm.

A: No spreading was observed at all.

B: Formation of spreading was slightly observed.

C: Formation of spreading was weakly observed.

D: Formation of spreading was clearly observed.

(Evaluation on the Light Fastness)

The printed images were each exposed to xenon fade meter (70,000 lux), and the reflective density at the portion of reflective density of 1.0 of the cyan image was measured by the densitometer X-rite 310 and the image density remaining ratio to the image density before the exposure was calculated and evaluated according to the following norm.

A: The image density remaining ratio was not less than 95%.

B: The image density remaining ratio was not less than 90% and less than 95%.

C: The image density remaining ratio was not less than 85% and less than 90%.

D: The image density remaining ratio was less than 85%.

(Confirmation of Burr Formation)

The situation of the burrs formation at the edges of the printed image was visually observed and evaluated according to the following norm.

A: No burr was observed.

B: Slight burrs were partially observed.

C: Burrs were clearly observed.

D: Considerable many burrs were observed.

(Evaluation on the Anti-wearing Property)

The surface of the transferred protective layer was rubbed by plastic eraser for 20 times of going and returning while applying a load of 2N. And then the situation of the image and the protective layer were visually observed to evaluate the anti-wearing property according to the following norm.

A: No variation was observed on the image.

B: Slight turbid of the protective layer was observed even though any variation did not occur on the image.

C: The protective layer was worn even though any variation did not occur on the image.

D: The image was worn.

The results obtained as above are listed in Table 4.

TABLE 4

| | | | Evaluation results | | | | | | |
|---|---|---|---|---|---|---|---|---|---|
| Printed image No. | Protective layer transfer sheet | Thermal transfer ink sheet | Printed image density | White background density | Variation of white background density | Image spreading resistivity | Light fastness | *1 | *2 |
| 1 | 1 | 1 | A | A | A | A | A | A | A |
| 2 | 2 | 1 | A | A | A | A | A | A | A |
| 3 | 3 | 1 | A | A | A | A | A | A | A |
| 4 | 4 | 1 | B | B | B | A | A | A | A |
| 5 | 5 | 1 | A | A | A | A | A | A | A |
| 6 | 6 | 1 | A | A | A | A | A | A | A |
| 7 | 7 | 1 | A | A | A | A | A | A | A |
| 8 | 8 | 1 | A | A | A | A | A | B | A |
| 9 | 9 | 1 | B | A | A | A | B | A | A |
| 10 | 10 | 1 | A | A | A | A | B | A | A |
| 11 | 11 | 1 | A | A | A | A | A | A | A |
| 12 | 12 | 1 | A | A | A | A | A | A | A |
| 13 | 13 | 1 | A | A | A | A | A | A | B |
| 14 | 14 | 1 | A | B | B | A | A | A | B |
| 15 | 15 | 1 | A | A | A | A | B | A | B |
| 16 | 16 | 1 | A | A | A | A | A | A | A |
| 17 | 17 | 1 | A | A | A | A | A | A | A |
| 18 | 18 | 1 | A | A | A | A | A | A | A |
| 19 | 19 | 1 | A | A | A | A | A | A | A |
| 20 | 20 | 1 | A | B | A | A | A | A | A |
| 21 | 21 | 1 | A | B | B | A | B | A | A |
| 22 | 22 | 1 | A | B | B | A | B | A | A |
| 23 | 23 | 1 | A | A | A | A | A | A | A |
| 24 | 24 | 1 | A | A | A | A | A | A | A |
| 25 | 25 | 1 | A | A | A | A | A | A | A |
| 26 | 26 | 1 | A | A | A | B | B | A | A |
| 27 | 27 | 1 | A | A | A | A | A | A | B |
| 28 | 28 | 1 | A | A | A | A | A | A | B |
| 29 | 29 | 1 | A | A | A | A | A | A | A |
| 30 | 30 | 1 | A | A | A | A | A | A | A |
| 31 | 31 | 1 | A | A | A | A | A | A | A |
| 32 | 32 | 1 | A | A | A | B | B | A | A |
| 33 | 33 | 1 | A | A | A | A | A | A | A |
| 34 | 34 | 1 | A | A | A | A | A | A | A |
| 35 | 35 | 1 | B | D | D | B | B | A | A |
| 36 | 36 | 1 | C | B | B | A | B | A | A |
| 37 | 37 | 1 | B | B | D | A | D | A | A |
| 38 | 38 | 1 | C | B | D | A | D | A | A |
| 39 | 39 | 1 | C | D | D | C | C | A | B |
| 40 | 40 | 1 | B | C | D | C | B | A | B |
| 41 | 41 | 1 | C | B | A | A | C | A | B |
| 42 | 42 | 1 | C | B | A | A | C | A | B |
| 43 | — | 2 | A | A | A | A | A | A | A |

*1: Burrs

*2: Anti-wearing property

Inv.: Inventive

Comp.: Comparative

As is cleared in Table 4, it is under stood that the printed images according to the invention formed by the use of the protective layer transfer sheet having the transferable image protective layer unit which is constituted by plural transferable resin layers and at least one of them contains the metal ion-containing compound and the resin layer different from the layer containing the metal ion-containing compound contains the UV absorbent, and the barrier layer is arranged between the layer containing the metal ion-containing compound and the layer containing the UV absorbent, are higher in the image density, lower in the white background density, and lower in the variation of the white background density during the prolonged storage period than those of the comparative examples and superior in the spreading resistivity, the light fastness and the anti-wearing property, and the formation of the burrs at the edge of the image is small.

The invention claimed is:

1. A protective layer transfer sheet comprising a transferable image protective layer unit on a support for forming a protective layer by thermally transferring on an image which is formed by method comprising the steps of;

overlaying a thermal transfer image receiving sheet having a thermal diffusible dye receiving layer on an support and a thermal transfer recording ink sheet having an ink layer containing a thermal diffusible dye capable of forming a chelate complex with a compound containing a metal ion, and heating the thermal transfer image receiving sheet and the thermal transfer recording ink sheet according to signals to be recorded to form an image in the diffusible dye receiving layer, wherein the transferable image protective layer unit comprises plural transferable resin layers, in which at least one of the resin layers contains the metal ion-containing compound, a resin layer other than the resin layer containing the metal ion-containing compound contains a UV absorbent, and a barrier resin layer is provided between the resin layer containing the metal ion-containing compound and the resin layer containing the UV absorbent.

2. The protective layer transfer sheet of claim 1, wherein the UV absorbent is an inorganic oxide having UV absorbing ability.

3. The protective layer transfer sheet of claim 2, wherein the inorganic oxide having UV absorbing ability is powder of titanium oxide or zinc oxide each having an average diameter of not more than 200 nm.

4. The protective layer transfer sheet of claim 1, wherein the UV absorbent is a UV absorbing resin.

5. The protective layer transfer sheet of claim 4, wherein a molecular weight of the UV absorbing resin is 5,000 to 250,000.

6. The protective layer transfer sheet of claim 1, wherein the ink layer of the thermal transfer recording ink sheet and the transferable image protective layer unit are provided on the same support separately.

7. The protective layer transfer sheet of claim 1, wherein the transferable image protective layer unit is provided on the support other than the support of the thermal transfer recording ink sheet.

8. The protective layer transfer sheet claim 1, wherein the transferable image protective layer unit comprises a parting layer.

9. The protective layer transfer sheet of claim 1, wherein the transferable image protective layer unit comprises an adhering layer.

10. The protective layer transfer sheet of claim 1, wherein a thickness of the barrier layer is from 1.0 to 10 μm.

11. An image forming method comprising the steps of overlaying a thermal transfer image receiving sheet having a thermal diffusible dye receiving layer on an support and a thermal transfer recording ink sheet having an ink layer containing a thermal diffusible dye capable of forming a chelate complex with a compound containing a metal ion, heating the thermal transfer image receiving sheet and the thermal transfer recording ink sheet according to signals to be recorded to form an image in the diffusible dye receiving layer, and forming a protective layer by thermal transfer employing a protective layer transfer sheet, wherein the protective layer transfer sheet comprises a support having thereon a transferable image protective layer unit, in which the transferable image protective layer unit comprises plural transferable resin layers, at least one of the resin layers contains the metal ion-containing compound, a resin layer other than the resin layer containing the metal ion-containing compound contains a UV absorbent, and a barrier resin layer is provided between the resin layer containing the metal ion-containing compound and the resin layer containing the UV absorbent.

12. The image forming method of claim 11, wherein the UV absorbent is an inorganic oxide having UV absorbing ability.

13. The image forming method of claim 12, wherein the inorganic oxide having UV absorbing ability is powder of titanium oxide or zinc oxide each having an average diameter of not more than 200 nm.

14. The image forming method of claim 11, wherein the UV absorbent is a UV absorbing resin.

15. The image forming method of claim 14, wherein a molecular weight of the UV absorbing resin is 5,000 to 250,000.

16. The image forming method of claim 11, wherein the ink layer of the thermal transfer recording ink sheet and the transferable image protective layer unit are provided on the same support separately.

17. The image forming method of claim 11, wherein the transferable image protective layer unit is provided on the support other than the support of the thermal transfer recording ink sheet.

18. The image forming method of claim 11, wherein the transferable image protective layer unit comprises a parting layer.

19. The image forming method of claim 11, wherein the transferable image protective layer unit comprises an adhering layer.

20. The image forming method of claim 11, wherein a thickness of the barrier layer is from 1.0 to 10 μm.

* * * * *